US005839266A

United States Patent [19]

Anthony et al.

[11] Patent Number: 5,839,266

[45] Date of Patent: Nov. 24, 1998

[54] VARIABLE SPEED TRASH BELT FOR OPEN-END SPINNING MACHINE AND METHOD

[75] Inventors: Phillip K. Anthony; Benjamin Eugene Ferguson, both of Pickens, S.C.

[73] Assignee: Cimtec Control Solutions, Inc., Charlotte, N.C.

[21] Appl. No.: 896,112

[22] Filed: Jul. 17, 1997

Related U.S. Application Data

[63] Continuation of Ser. No. 711,879, Sep. 12, 1996, Pat. No. 5,694,758.

[51] Int. Cl.[6] ..... D01H 11/00

[52] U.S. Cl. ..... 57/301; 57/406; 57/408

[58] Field of Search ..... 57/301, 406, 408, 57/409, 410, 411, 412, 413, 92; 15/256.5; 198/496

[56] References Cited

U.S. PATENT DOCUMENTS

| | | | |
|---|---|---|---|
| 3,777,329 | 12/1973 | Lane | 57/301 |
| 3,884,028 | 5/1975 | Stahlecker et al. . | |
| 3,924,397 | 12/1975 | Stahlecker et al. . | |
| 3,959,961 | 6/1976 | Stahlecker . | |
| 3,975,895 | 8/1976 | Stahlecker | 57/301 |
| 4,098,065 | 7/1978 | Stahlecker et al. . | |
| 4,162,556 | 7/1979 | Van Ditshuizen et al. . | |
| 4,183,201 | 1/1980 | Stahlecker | 57/301 |
| 4,483,135 | 11/1984 | Kurushima et al. . | |

OTHER PUBLICATIONS

Schlafhorst Autocoro; *Automated Double–Sided Rotor Spinning and Winding Center;* All Pages; May 1985; and Place of Publication Unknown.

*Primary Examiner*—William Stryjewski
*Attorney, Agent, or Firm*—Adams Law Firm, P.A.

[57] ABSTRACT

A method of reducing trash recirculation into the fiber formation stream of an open-end spinning machine yarn formation station in an open-end spinning machine of the type having a movable trash belt which collects trash removed from the yarn during formation. The method comprises the steps of moving the trash belt at a first predetermined rate of movement for a predetermined period of time, moving the trash belt at a second predetermined rate of movement less than the first rate of movement for a predetermined period of time, cleaning the trash belt and repeating the steps.

5 Claims, 6 Drawing Sheets

VARIABLE SPEED TRASH BELT FOR OPEN-END SPINNING MACHINE AND METHOD

This application is a continuation of application Ser. No. 08/711,879, filed on Sep. 12, 1996, now U.S. Pat. No. 5,694,758.

TECHNICAL FIELD AND BACKGROUND OF THE INVENTION

This invention relates to a variable-speed trash belt for an open-end spinning machine and a method of controlling the speed of the trash belt of an open-end spinning machine. As described below, careful control of the rate of movement of the trash belt improves both machine efficiency and yarn quality.

In the open-end spinning process the fibers to be spun into a yarn on the machine are removed from a sliver supplied to the machine, separated, and then spun into a yarn in the rotor or other yarn-producing mechanism. Each machine contains numerous adjacent stations. The opening of the sliver into individual fibers occurs in opening devices of varying types which reside in upstream fiber-flow proximity to the rotor. Typically, an opening roller having spikes or sawteeth on its circumference rotates in the opening device. It is these spikes or sawteeth that comb or tease the fibers out of the sliver.

At the input end of the station the sliver is drawn from a sliver can or bobbin into the opening device by a feed roller. An intake opening guide plate is pressed against the feed roller with a predetermined spring force. The trash contained in the sliver, which may include dust, seeds, insect fragments and neps, is forced out of the sliver by the opening roller and is physically separated from the fibers.

The density of the trash is relatively high in comparison with the density of the fibers. The trash therefore gains greater kinetic energy than the fibers as the fibers and trash are carried into the radial outer region of the gap between the opening roller and housing wall. This tends to separate the trash from the fiber by centrifugal force as the trash moves outwardly at a greater rate and with greater energy than the fibers.

A discharge opening is located below the opening roller through which the trash falls. The trash is collected on a moving endless trash belt which is intended to carry the trash to one end of the machine, where a cleaning element, such as a brush roller, removes the trash from the belt. The cleaned belt rotates continually, so that each area of the belt alternates through successive trash-accumulating and trash-cleaning cycles.

Ideally, the belt has a fibrous nap to which the trash clings until it reaches the trash removal area at one end of the machine. However, after a relatively short period of time the belt becomes worn and progressively less able to physically retain the trash on its surface along the length of the machine. Vibration, air currents and other conditions can therefore cause some of this loose trash on the belt to be sucked back into the discharge opening or other access opening of a downstream station as the trash is carried along the length of the machine towards the trash removal area.

Reintroduction of trash into the fiber stream can cause the yarn to break or form slubs, which is usually sensed by stop-motion devices on the machine. At this point, the yarn must be pieced up either manually or automatically. This clearly reduces machine efficiency by stopping the output of yarn from the station until piece-up is completed. Even smaller trash which does not cause the yarn to break decreases the quality of the yarn by reintroducing trash into the yarn.

It has been noticed in the mill environment that during times of belt stoppage due to malfunction, machine efficiency increased somewhat, but to applicants' knowledge the reason for this was not appreciated. Applicants also believe that for a time the trash belt of a Schlafhorst SE 9 was manually stopped by overriding safety circuits in recognition that machine efficiency increased somewhat. To applicants' knowledge, this practice was abandoned because operators either forgot to stop the belt at the proper intervals or, after stopping them, forgot to restart them.

In addition, applicants are aware of at least one machine that was equipped for a short period of time with a single phase to three phase AC inverter which was capable of varying the trash belt speed, but which did not work satisfactorily, was not supported by the machine manufacturer, was removed and its use abandoned.

The invention according to this application represents a satisfactory and cost-effective solution to the problems described above. The practice of the invention can be varied within wide parameters to take into account mill conditions, sliver quality and trash content, machine and trash belt age and condition. Empirical use of the invention permits optimized operation of the open-end machine and high quality yarn without increased cost.

SUMMARY OF THE INVENTION

Therefore, it is an object of the invention to provide a variable-speed trash belt for an open end spinning machine and method which increases open-end spinning machine efficiency.

It is another object of the invention to provide a variable-speed trash belt for an open end spinning machine and method which increases the quality of the yarn being spun on the open-end spinning machine.

It is another object of the invention to provide a variable-speed trash belt for an open end spinning machine and method which reduces the ambient dust level in the area of the open-end spinning machine.

It is another object of the invention to provide a variable-speed trash belt for an open end spinning machine and method which utilizes a "soft start" transition between belt movement rates to prevent trash on the belt from being vibrated or shaken loose and reintroduced into adjacent air currents.

It is another object of the invention to provide a variable-speed trash belt for an open end spinning machine and method which interrupts trash belt movement in order to allow air-entrained dust and trash to settle onto the trash belt.

It is another object of the invention to provide a variable-speed trash belt for an open end spinning machine and method which increases the life and maintenance intervals of the trash belt, belt motor, pulleys and other moving parts.

These and other objects of the present invention are achieved in the preferred embodiments disclosed below by providing a method of reducing trash recirculation into the fiber formation stream of an open-end spinning machine yarn formation station in an open-end spinning machine of the type having a movable trash belt which collects trash removed from the sliver during yarn formation. The method comprises the steps of moving the trash belt at a first predetermined rate of movement for a first predetermined period of time, moving the trash belt at a second predetermined rate of movement less than the first rate of movement for a second predetermined period of time, cleaning the trash belt and repeating the steps.

According to one preferred embodiment of the invention, the first predetermined rate of movement of the trash belt is greater than zero meters per minute and the second rate of movement of the trash belt is zero meters per minute.

According to another preferred embodiment of the invention, the first rate of movement is X meters per minute and the second rate of movement is between zero and ½X meters per minute.

According to yet another preferred embodiment of the invention, the first period of time is at least the period of time required for at least one complete passage of the trash-laden portions of the trash belt past a belt-cleaning station.

According to yet another preferred embodiment of the invention, the first predetermined period of time and the second predetermined period of time are the same.

Preferably, the first predetermined period of time and the second predetermined period of time are different.

According to yet another preferred embodiment of the invention, an electric motor moves the trash belt. The steps of moving the trash belt at a first predetermined rate of movement and moving the trash belt at a second predetermined rate of movement comprises the steps of providing a motor for controlling the rate of movement of the trash belt.

According to yet another preferred embodiment of the invention the step of providing a motor for controlling the rate of movement of the trash belt comprises the step of controlling the speed rotation of the motor by applying a variable frequency current to the motor.

According to yet another preferred embodiment of the invention, the method includes the step of moving the trash belt from the second predetermined rate of movement to the first rate of movement in incremental steps to provide a soft transition between the second and first rates of movement of the belt.

According to yet another preferred embodiment of the invention, the method includes the step of providing rate of movement and time controls for the belt which are incrementally variable between upper and lower predetermined ranges.

An apparatus for reducing trash recirculation into the fiber formation stream of an open-end spinning machine yarn formation station in an open-end spinning machine of the type having a motor-driven trash belt which collects trash removed from the sliver during yarn formation according to a preferred embodiment of the invention comprises motor control means operatively connected to the motor for varying the output rpms of the motor to the belt between at least first and second predetermined rates of belt movement, timing means operatively connected to the motor for controlling the period of time of each of the first and second predetermined rates of belt movement, and operator input means operatively connected to the motor control means and the timing means for permitting operator input of predetermined rate of belt movement and time values.

Preferably, a variable frequency input means for applying a variable frequency to the motor.

Preferably, the motor control means comprises an inverter for outputting a variable frequency to the motor.

According to another preferred embodiment of the invention, the motor control means comprises a variable voltage input means for applying a variable voltage to the motor.

According to yet another preferred embodiment of the invention, the motor control means comprises a variable voltage/variable frequency input means for outputting a variable voltage and/or a variable frequency to the motor.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
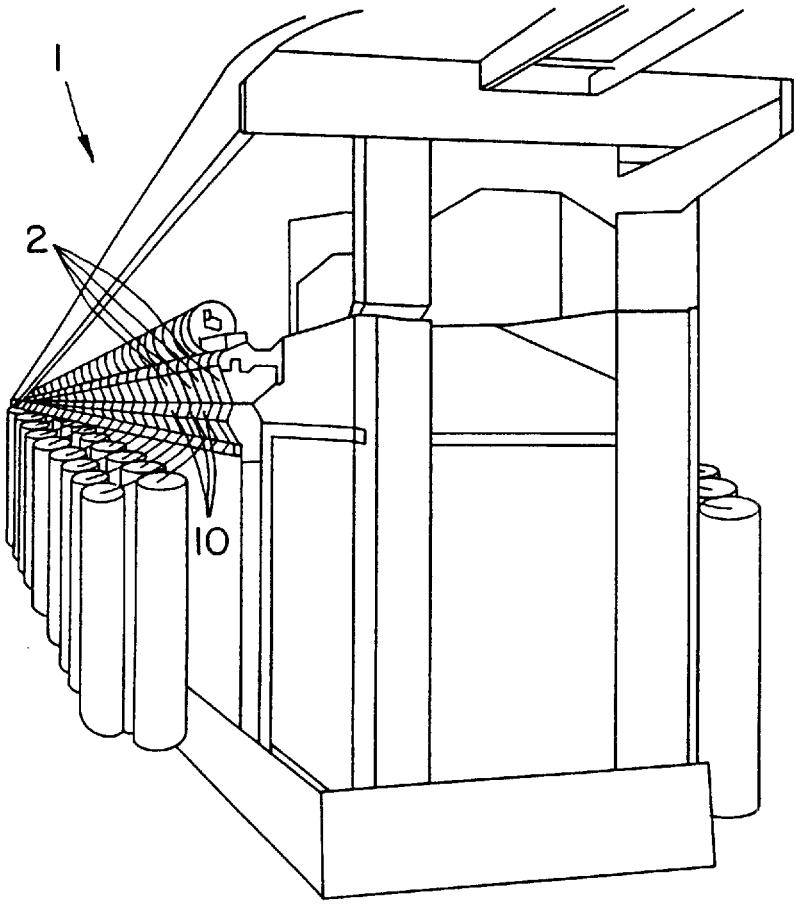
FIG. 1 PRIOR ART
FIG. 1 is a simplified perspective view of an open-end spinning machine.

Referring now specifically to the drawings, a conventional open-end spinning machine according to the present invention is illustrated in FIG. 1 and shown generally at reference numeral 1. For purposes of illustration the invention is described with reference to a Schlafhorst Model SE 9 open-end spinning machine, broadly illustrated in FIG. 1. However, the invention is equally applicable to other machines which utilize trash belts to carry away trash removed from the sliver during yarn formation on the machine.

Spinning machine 1 includes numerous adjacent spinning stations 2 along the length of both sides of the machine 1.

Figure 2:
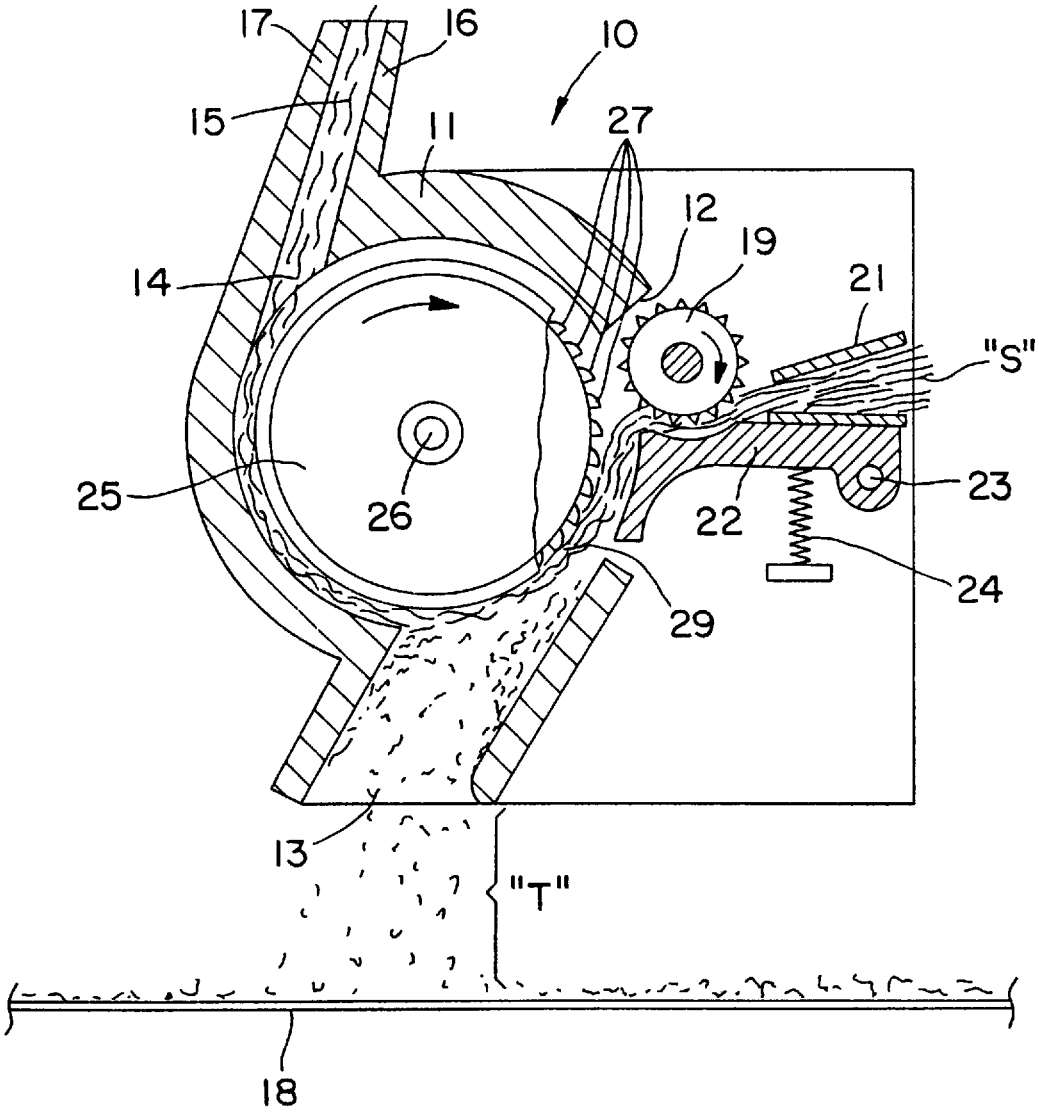
FIG. 2 is a cross-sectional view of an opening device on an open-end spinning machine of the type with which the invention is practiced.

Referring now to FIG. 2, each station 2 includes an opening device 10, which includes a housing 11 with an intake opening 12 for the sliver being formed into yarn. A trash discharge passage 13 and a fiber feeding opening 14 for feeding the separated fibers to the spinning rotor, not shown, through a fiber guide passage 15 is formed within walls 16 and 17. The trash discharge passage 13 extends downwardly and opens directly above a trash belt 18. Trash belt 18 is an endless conveyor-type belt which moves successively through a cycle where trash is deposited onto its surface and a cleaning cycle where a brush or other device, not shown, removes the trash for disposal. The trash belt 18 may be driven by its own motor, as in the Schlafhorst SE 9, or may be driven by the main machine drive, as in the Schlafhorst SE 8.

A sliver feed roller 19, which rotates in a clockwise direction draws a sliver "S" under a compressor plate 21 through a movable intake opening guide plate 22 into the intake opening 12 of the housing 11. The intake opening guide plate 22 is pivotally supported on the housing wall by a pin 23 and urged by a spring 24 against the sliver feed roller 19.

In the housing 11, an opening roller 25 rotates in a counterclockwise direction on a shaft 26 which is supported in the housing 11. On its circumference, the opening roller 25 has an array of sawtooth-like combing elements 27 formed in a predetermined pattern on its outer circumference. These combing elements 27 comb individual fibers out of the sliver "S" as it is passed from under the sliver feed roller 19 into contact with the opening roller 25.

As a result of airflow induced in the housing 11, the separated fibers are entrained by the air flow and carried through the fiber guide passage 15 to the spinning unit. The trash "T" expelled from the stream of individual fibers normally has a greater density than the fibers and is therefore expelled centrifugally from the fibers into the trash discharge passage 13.

Note in FIG. 2 that the wall 16 is separated from the intake opening guide plate 22 by an opening 29. It has been determined that loose trash on the trash belt 18 can be reintroduced through this opening 29, through the trash discharge opening 13 or through other spaces back into the airflow within which the cleaned, separated fiber is moving in the fiber feeding opening 14.

This is believed to occur as the result of the trash belt 18 moving along the length of the open-end spinning machine during machine operation, as described above.

In accordance with the invention, therefore, the trash belt 18 is controlled in several ways calculated to minimize reintroduction of trash into the fiber formation areas of the opening device 10.

Figure 3:
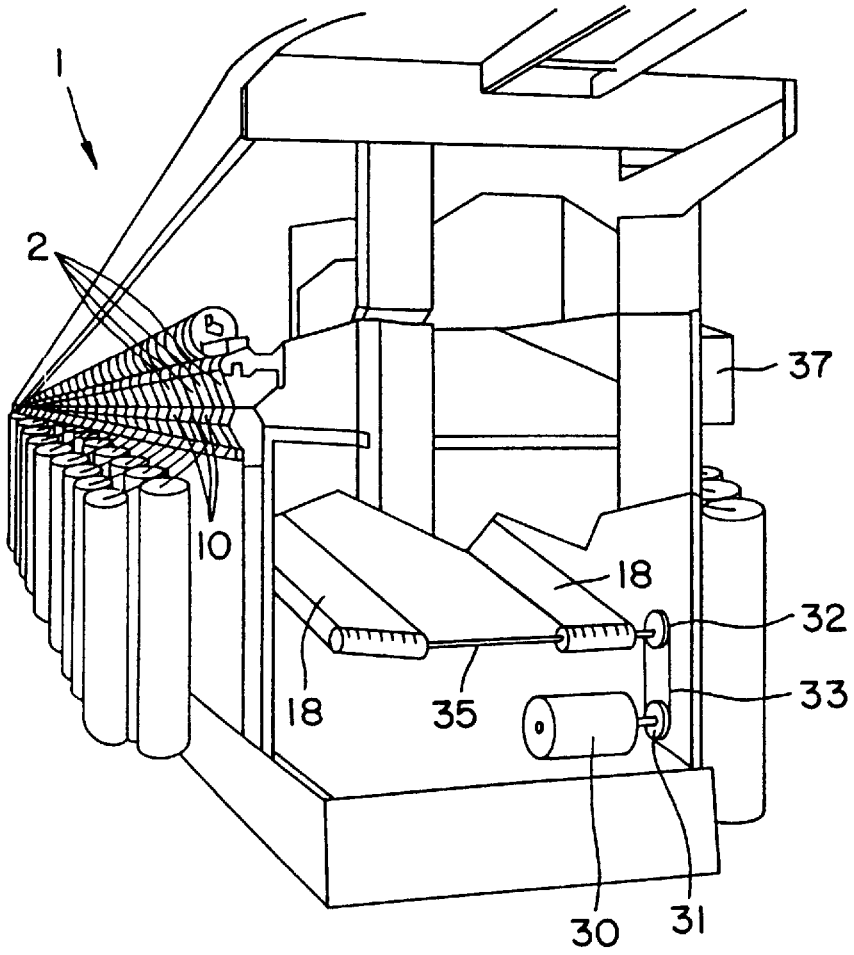
FIG. 3 is a view according to FIG. 1 with parts broken away to expose the trash belts and the motor drive for the trash belts.

Referring now to FIG. 3, the trash belts 18 of the open-end spinning machine 1 extend down the length of the machine frame from one end to the other. In the particular embodiment of open-end spinning machine used in this application for purposes of illustration, both belts 18 are driven by a single motor 30 through drive and driven pulleys 31 and 32 rotatably connected by a drive belt 33. The other belt 18 is rotated by a solid concentric shaft 35 extending from one belt 18 to the other. A typical motor 30 used for this application is a ⅓ HP constant frequency, 1750 rpm, 60 Hz, 3-phase AC motor.

Conventional machine operation requires that the belts 18 rotate continuously at a relatively high rate of travel, on the order of 59–60 meters per minute. The Schlafhorst SE 9 does not have a "Stop/Start" control for the trash belts 18. Rather, a safety circuit must be overridden.

Figure 4:
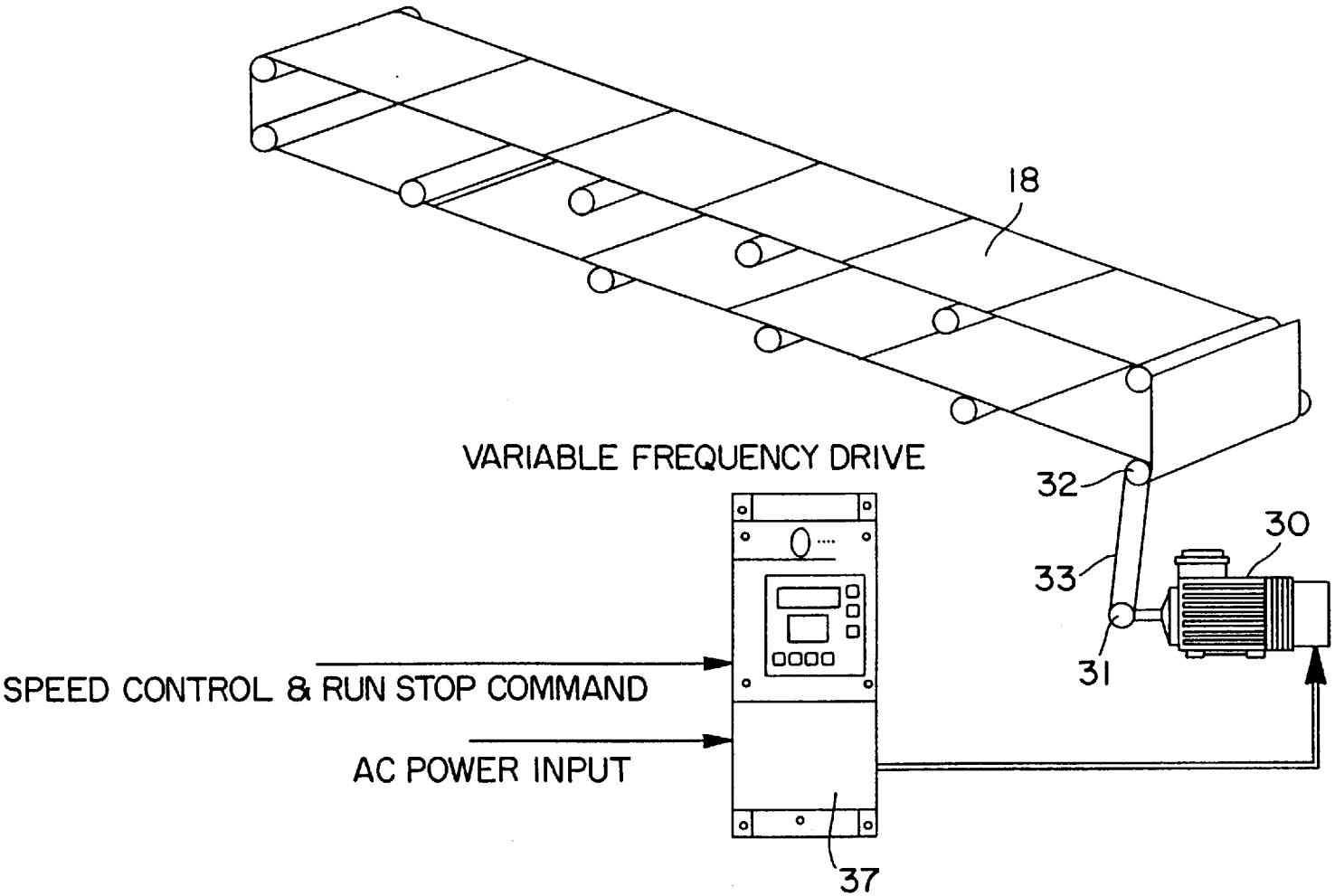
FIG. 4 is a schematic diagram showing the trash belt, motor and controller.

In accordance with a preferred embodiment of the invention, FIG. 4 illustrates that an adjustable frequency drive, or inverter, 37, is wired to the motor 30. A suitable inverter 37 is the General Electric AF-300 family of inverters, selected according to conventional selection criteria to match the particular motor 30 being controlled.

Inverter 37 is equipped with a control keypad which permits frequency selection, timing values and other status conditions. Such inverters 37 can dwell for up to 6,000 seconds, or 100 minutes. This permits a very wide range of speeds and time intervals between belt 18 movement cycles.

Alternatively, motor 30 can be controlled by controlling only voltage to the motor, or with a combination of voltage and frequency variation.

Inverter 37 can thus control the belts 18 in various ways. Several of these are shown in FIGS. 5–9, where time is plotted horizontally and velocity of the belts 18 vertically. For example, in FIG. 5 a "soft start" and "soft stop" profile is shown, where the inverter 37 "dwells", for example, 50–55 minutes each hour, and then gradually increases in speed from standstill to 15–20 meters/minute. The belts 18 move for from 5 to 10 minutes, or whatever other time empirical study has indicated will adequately clean the trash belts 18. The inverter 37 then gradually slows and finally stops for another 50–55 minutes.

Figure 6:
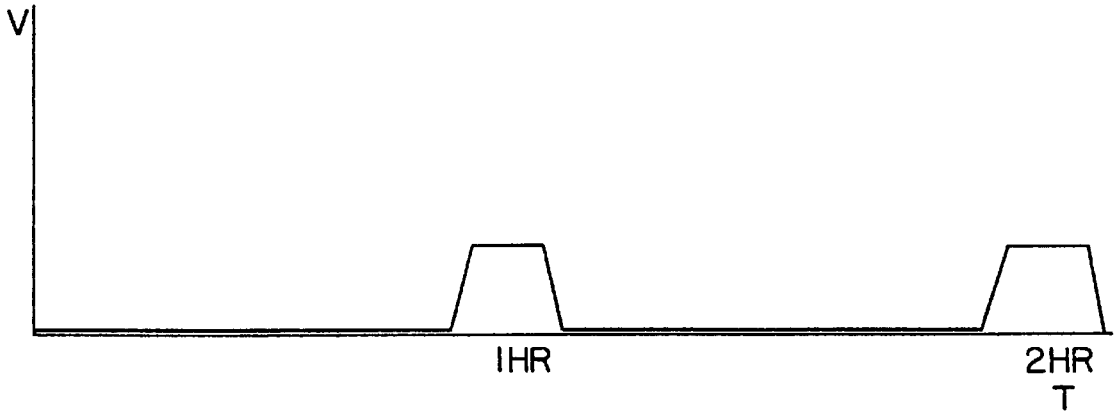

FIG. 6 illustrates that the belt 18 need not be started gradually, but can rapidly increase to the desired belt velocity.

Figure 5:
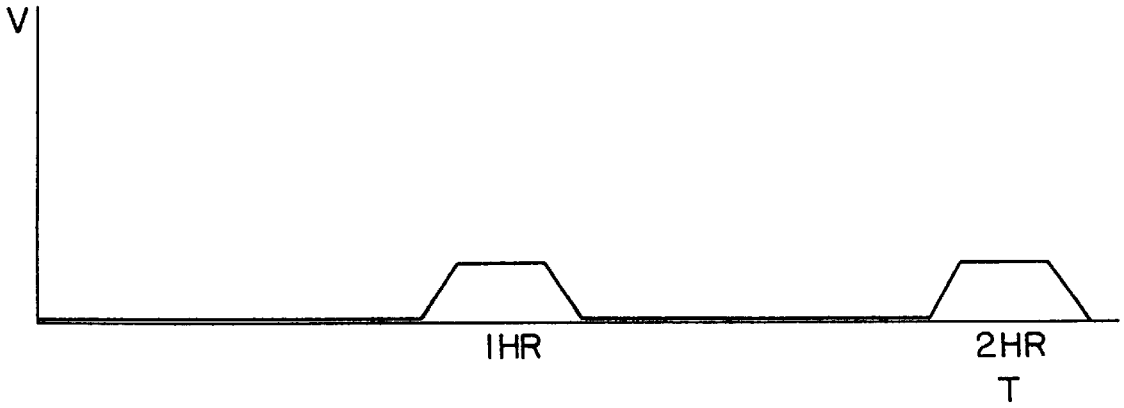
FIGS. 5–9 are tables plotting several examples of velocity and time profiles according to various embodiments of the invention.
Figure 7:
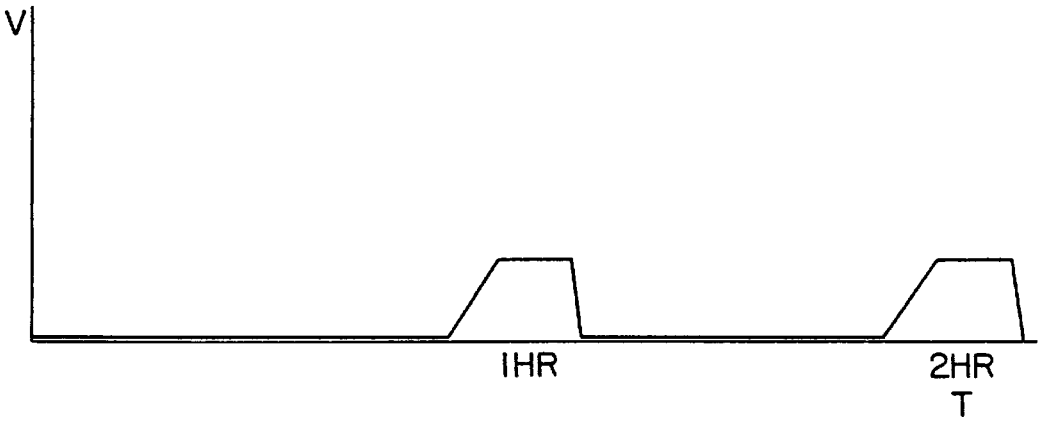

FIG. 7 illustrates that it may be desirable to start the belts 18 gradually, as in FIG. 5, but need not be stopped gradually. Gradual start-up reduces the tendency of the sudden belt movement to shake loose or vibrate the trash off of the belts 18 and back into the air where it can be sucked into the yarn forming mechanisms, as described above. However, since the belts 18 are clean after the cleaning cycle, it makes little difference whether the belts 18 are stopped gradually or in the normal manner.

Figure 8:
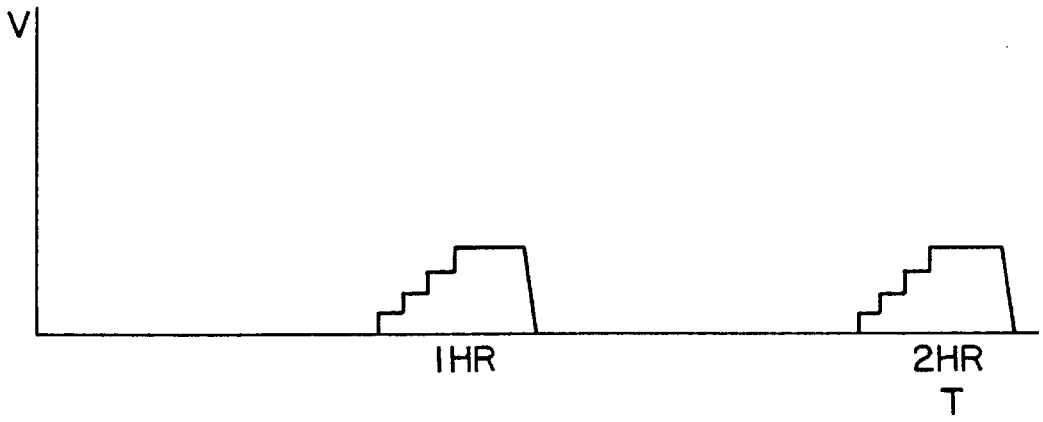

FIG. 8 illustrates that the start-up can be made incrementally, with pauses at two or more intermediate belt velocities. This is another form of "soft start."

Figure 9:
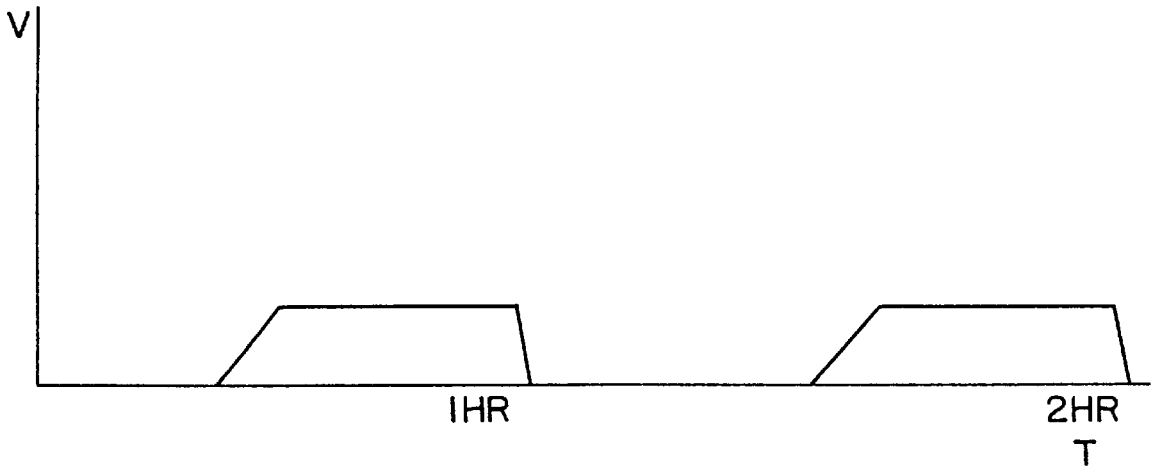

FIG. 9 illustrates that the predetermined rates of belt velocity and the predetermined periods of time can vary considerably. For example, in FIG. 9, the belt 18 is rotated for 30 minutes and stopped for 30 minutes, using the velocity profile shown in FIG. 5.

The appropriate time interval of belt movement is determined by first observing the number of revolutions of the belt 18 necessary to adequately clean it. This is then converted into time and input through the keypad on the inverter 37.

Applicants have determined that in most cases the conventional belt velocity is approximately three times too high without regard to the particular velocity profile used. Applicants have successfully designed and installed systems wherein the belts 18 are operated at approximately one-third the conventional belt velocity continuously with increased machine efficiency and yarn quality. This was accomplished by removing the belt pulley where the speed sensor is located and adding two more pick-up points. This causes the speed sensor to believe that the belts 18 are still rotating at the original speed.

An example of use of the method and apparatus is set out below:

| | |
|---|---|
| Belt stopped time interval | 30 minutes |
| Belt moving time interval | 5 minutes |
| Belt velocity (meters/minute) | 20 meters/minute |
| Inverter Model No. | GE AF-300M$ |

The GE AF-300M$ inverter, Catalog No. D5564, is a 380/460 V, 1 HP Drive.

The rate of increase of belt velocity during "soft starts" is not critical, the point being to start the belt 18 sufficiently slowly to keep from shaking dust and trash into the air. It is believed that a "ramp up" to maximum belt velocity over 5–10 seconds fulfills this condition.

A variable-speed trash belt for open-end spinning machine method is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. A method of reducing trash recirculation into a fiber formation stream of an open-end spinning machine yarn formation station in an open-end spinning machine having a movable trash belt which collects trash removed from sliver during yarn formation, comprising the steps of:

(a) moving the trash belt at a first predetermined rate of movement for a first predetermined period of time;

(b) moving the trash belt at a second predetermined rate of movement less than the first rate of movement for a second predetermined period of time;

(c) cleaning the trash belt at least during step (a); and (d) repeating steps (a) through (c).

2. A method according to claim 1, wherein said first predetermined rate of movement of the trash belt is greater than zero meters per minute and said second rate of movement of the trash belt is zero meters per minute.

3. A method according to claim 1, wherein said first rate of movement is X meters per minute and the second rate of movement is between zero and ½X meters per minute.

4. A method according to claim 1, and wherein before the moving step (a) including the step of providing a motor for controlling the rate of movement of the trash belt.

5. A method according to claim 4, wherein the step of providing a motor for controlling the rate of movement of the trash belt comprises the step of controlling the speed of rotation of the motor by applying a variable frequency to the motor.

* * * * *